US006907627B2

(12) United States Patent
Waldman et al.

(10) Patent No.: US 6,907,627 B2
(45) Date of Patent: Jun. 21, 2005

(54) FOLDABLE CRIB AND METHOD FOR USING SAME

(75) Inventors: Kenneth C. Waldman, Reading, PA (US); Jerome Drobinski, Reading, PA (US)

(73) Assignee: Simplicity, Inc., Reading, PA (US)

( * ) Notice: Subject to any disclaimer, the term of this patent is extended or adjusted under 35 U.S.C. 154(b) by 0 days.

(21) Appl. No.: 10/855,543

(22) Filed: May 27, 2004

(65) Prior Publication Data

US 2004/0244110 A1 Dec. 9, 2004

Related U.S. Application Data

(60) Provisional application No. 60/474,277, filed on May 29, 2003.

(51) Int. Cl.[7] ..... A47D 7/01; A47D 7/00; A47D 13/06

(52) U.S. Cl. ..... 5/99.1; 5/93.1; 5/177; 5/663

(58) Field of Search ..... 5/99.1, 93.1, 93.2, 5/176.1, 174, 177, 663

(56) References Cited

U.S. PATENT DOCUMENTS

| | | | | |
|---|---|---|---|---|
| 586,333 A | | 7/1897 | Doman | |
| 1,675,375 A | | 7/1928 | Netschert | |
| 2,059,058 A | | 10/1936 | Swanson | |
| 2,132,988 A | * | 10/1938 | Leibo | 403/95 |
| 2,135,517 A | | 11/1938 | Isbell et al. | |
| 2,536,357 A | | 1/1951 | David | |
| 2,553,579 A | * | 5/1951 | Harris | 5/99.1 |
| 2,561,637 A | * | 7/1951 | Rex | 5/99.1 |
| 2,781,527 A | * | 2/1957 | Landry | 5/99.1 |
| 4,483,026 A | | 11/1984 | Kassai | |
| 4,765,004 A | | 8/1988 | Kessel | |
| 6,014,781 A | | 1/2000 | Cone | |
| 6,651,275 B1 | * | 11/2003 | Rummell | 5/99.1 |
| 6,817,046 B1 | * | 11/2004 | Srour et al. | 5/99.1 |

FOREIGN PATENT DOCUMENTS

| | | |
|---|---|---|
| GB | 2 061 099 | 7/1980 |

* cited by examiner

*Primary Examiner*—Alexander Grosz
(74) *Attorney, Agent, or Firm*—Volpe and Koenig, P.C.

(57) ABSTRACT

A foldable crib having substantially similar head and foot ends and folding sides either fixedly or pivotally mounted to the head and foot ends, the pivotally mounted ends closer to the head and foot ends being spaced at differing lengths so as to provide a folded structure which is compact and provides a small "footprint" as well as providing a compartment for storing the crib mattress in an upright manner which further contributes to the small "footprint".

33 Claims, 10 Drawing Sheets

FOLDABLE CRIB AND METHOD FOR USING SAME

CROSS REFERENCE TO RELATED APPLICATION

This application claims priority from U.S. Provisional Application No. 60/474,277 filed on May 29, 2003, which is incorporated by reference as if fully set forth.

FIELD OF THE INVENTION

The present invention relates to cribs. More particularly, the present invention relates to foldable cribs which are simple to operate and which provide a highly compact arrangement when folded which further has a small "footprint".

BACKGROUND

Facilities such as daycare centers, shelters employed for emergency purposes as well as homeless shelters, to name just a few, have the need for cribs, among other bedding. Since floor space is often quite precious, it is advantageous to utilize such floor space for a multiplicity of different functions. For example, the floor space may be utilized over-night for sleeping purposes and, during daylight hours, for daily activities such as eating, classroom activity and working, to name just a few. It is thus highly advantageous to provide bedding which may be folded up and stored during daylight hours or during periods of non-use and which occupies a minimum amount of space and thus makes a small "footprint" when so folded.

SUMMARY

The present invention is characterized by comprising a foldable crib having uniquely designed, foldable sidewalls which are easy to operate and yet provide a highly compact crib assembly when folded and which creates a well-defined storing region for supporting a crib mattress and mattress support in an upright fashion and in such a manner as to contribute to the small "footprint". The mattress support is pivotally mounted to the crib which allows the mattress to be easily moved between a folded and unfolded position. The mattress support includes a frame which snap-fits into holding clips in the unfolded position. The clips retain the mattress in place and rigidify the crib sides to provide a sturdy structure.

BRIEF DESCRIPTION OF THE FIGURES

The present invention will be understood from a consideration of the following description and drawings in which like elements are designated by like numerals and, wherein.

DETAILED DESCRIPTION OF THE INVENTION

Figure 1:
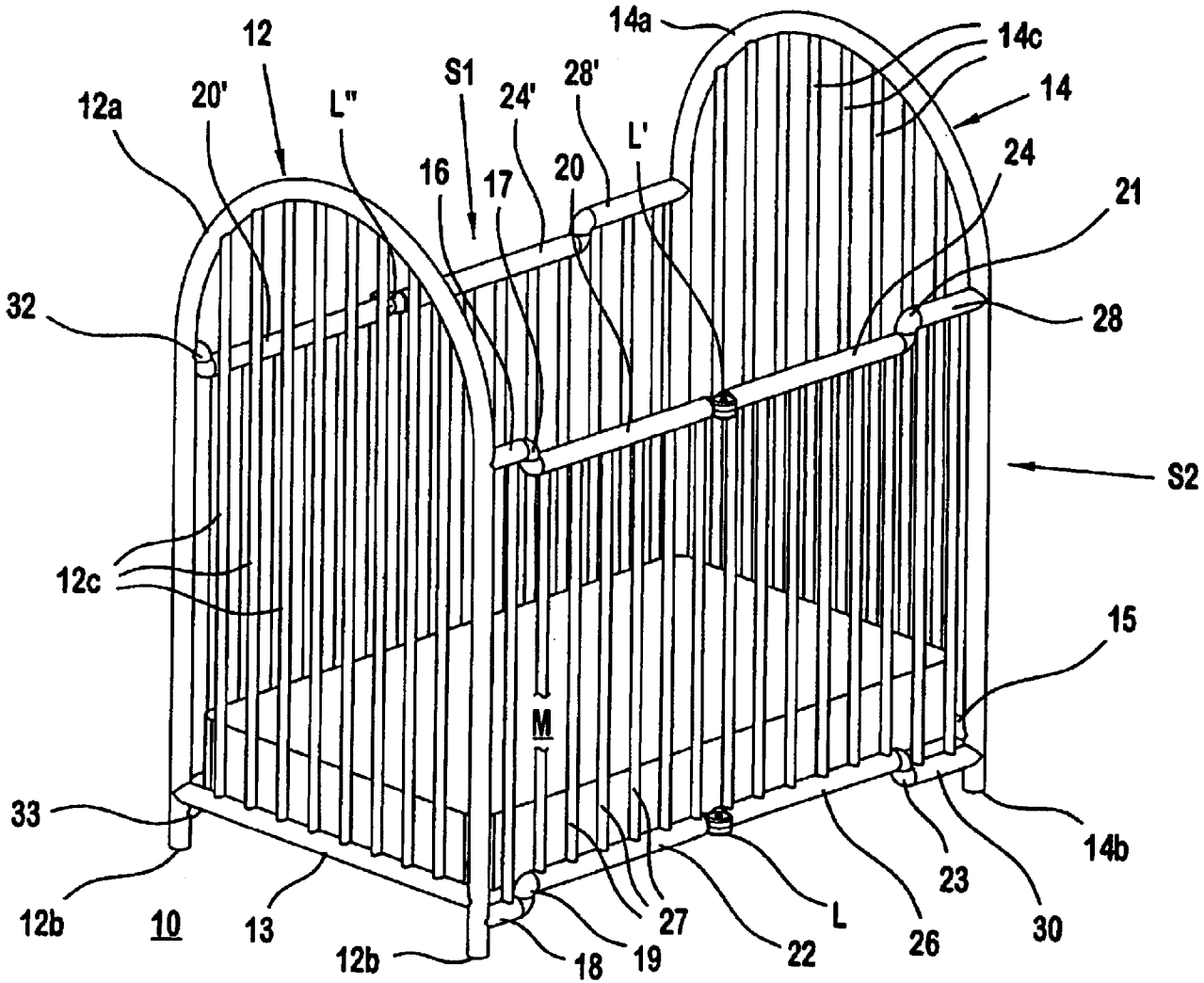
FIG. 1 is a perspective view showing a foldable crib embodying the principles of the present invention and occupying the unfolded position.

Certain terminology is used in the following description for convenience only and is not limiting. The words "right," "left," "lower," "upper," "top," and "bottom" designate directions in the drawings to which reference is made. The terminology includes the words noted above as well as derivatives thereof and words of similar import.

FIG. 1 shows a crib assembly 10 embodying the principles of the present invention and comprised of crib ends 12 and 14 and crib sides S1 and S2. Crib ends 12 and 14 can serve as a headboard and footboard, or vice versa, for the crib assembly 10. Crib ends 12 and 14 are substantially identical in design and function and are respectively comprised of inverted, substantially U-shaped members 12*a*, 14*a* the free ends of which form legs 12*b*, 14*b* which support the crib assembly 10. Optionally, the bottom of legs 12*b*, 14*b* may be fitted with casters (not shown). Each of the crib ends 12 and 14 are also provided with a plurality of spaced parallel members 12*c*, 14*c* joined at their upper ends to the yoke portion of the crib ends 12 and 14 and at their bottom ends to cross-pieces 13, 15 which are respectively joined to the lower ends of the crib ends 12 and 14.

The members 12*a*, 14*a*, 12*c*, 14*c*, 13 and 15 are preferably hollow, tubular members formed of a suitable metallic or plastic material. For example, these members may be formed of metal such as steel or aluminum or a suitable plastic material. However, the members 12*a*, 14*a*, 12*c*, 14*c*, 13 and 15 may be solid and may be formed of wood, without departing from the spirit or scope of the invention.

A pair of stationary arms 16 and 18 have their left-hand ends fixedly secured to the right-hand side of crib end 12. A pair of arms 20 and 22 are pivotally coupled at their left-hand ends to the right-hand ends of stationary arms 16 and 18 by suitable pivot assemblies 17 and 19. The pivot assemblies 17, 19 may, for example, be pivot pins having their upper ends extending into arms 16 and 22 and their lower ends extending into arms 20 and 18.

The right-hand ends of arms 20 and 22 are pivotally coupled to the left-hand ends of arms 24 and 26. The combination locking/pivotal connections L and L' arranged therebetween are further provided with suitable locking members to lock the arms 22 and 26 and 20 and 24 in the unfolded position shown in FIG. 1, and further allowing the arms 20 and 24 and 22 and 26 to respectively pivot about the connections L' and L.

Figure 3A:
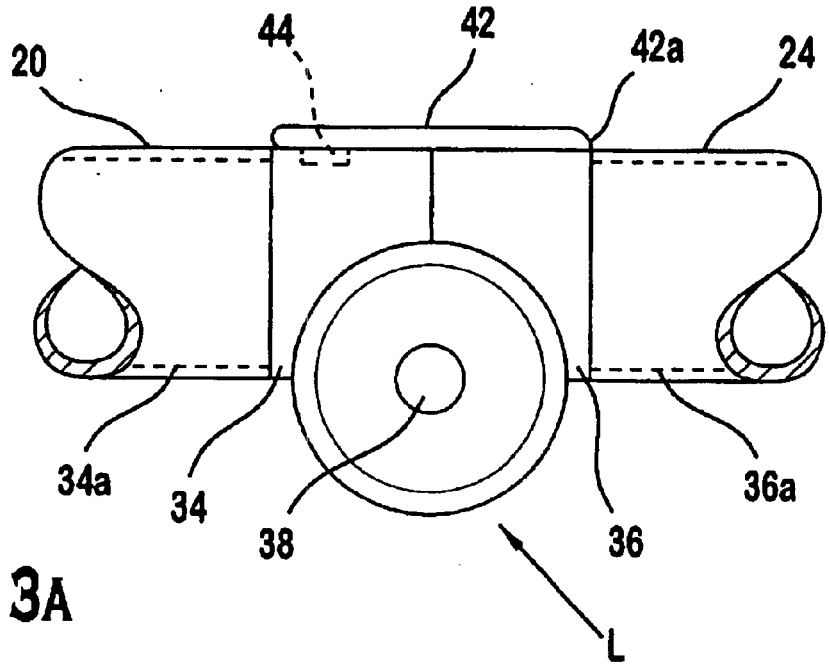
FIGS. 3A and 3B are detailed views of the locking/pivot members shown in FIGS. 1 and 2 and respectively showing the arms connected thereto in the unfolded and folded positions.
Figure 3B:
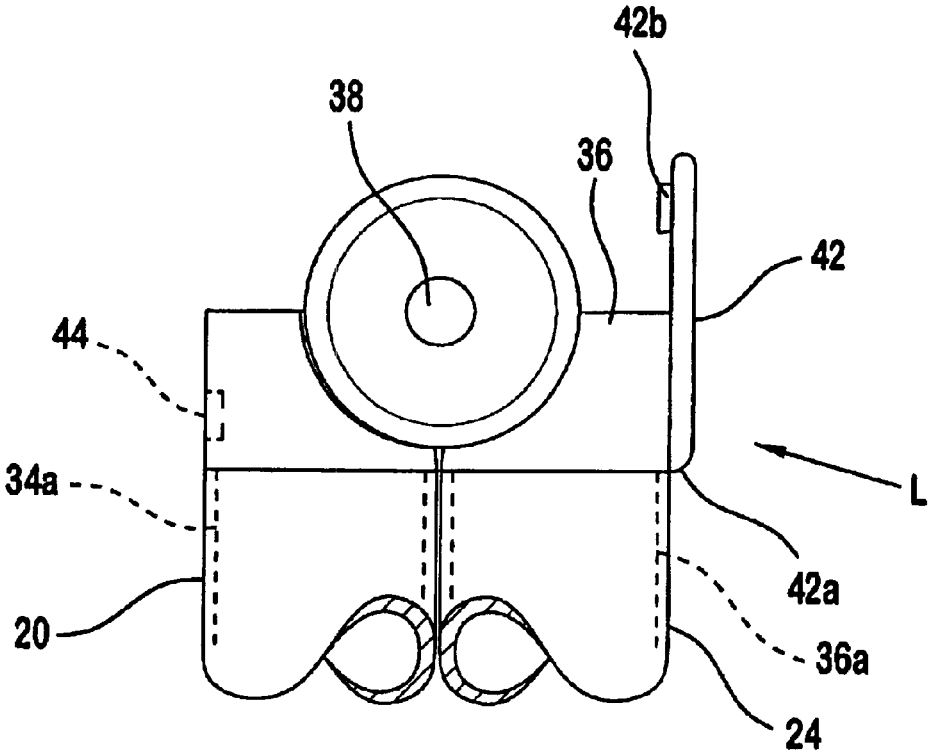

One such pivotal connection L is shown in FIGS. 3*a* and 3*b* wherein two (2) cooperating hinge halves 36 and 34 have their integral projections 36*a*, 34*a* respectively telescoped into arms 24 and 20. Hinge halves 36 and 34 are pivotally coupled to one another by hinge pin 38. A strap 42 has its right-hand end 42*a* integrally joined to hinge half 36 and has a snap member 42*b* arranged at its free end. A cooperating button 44 is arranged on hinge half 34. FIG. 3A shows the arms 20 and 24 in the unfolded position. In this position, strap 42 is pressed against hinge half 34 and snap member 42*b* is snap-fitted into button 44.

In order to unfold the arms, member 42 is unsnapped from button 44 and the arms 20, 24 are moved to the position shown in FIG. 3B. It should be understood that any other pivotal coupling/locking assembly may be employed which provides easy folding/unfolding and locking/unlocking.

The right-hand ends of arms 24 and 26 are respectively pivotally coupled to the left-hand ends of stationary arms 28 and 30 by pivot assemblies 21 and 23 which are similar in design and function to the pivot assemblies 17 and 19 described above. The right-hand ends of arms 28 and 30 are fixedly connected to the right-hand end of crib end 14, such connections may be made mechanically by suitable fasteners or by welding, for example. Arms 16, 20, 24 and 28 comprise an upper railing and arms 18, 22, 26 and 30 comprise a lower railing for side S2. Arms 20', 24' and 28' comprise an upper railing for side S1. The lower railing of side S1, which is hidden from view, is similar in design and function to the upper railing of side S1.

On the opposite side S1 of the crib, arm 28' is similar in function and design to arm 28 but is longer in length than arm 28. Arm 24' is similar in design and function to arm 24. Arm 20' is similar in design and function to arm 20 except that arm 20' is pivotally connected at its left-hand end to crib end 12 by a pivot assembly 32. Arms 20 and 20' and arms 24' and 24 are equal in length.

Lower arms that are substantially the same as upper arms 28', 24' and 20' on side S1 of crib 10 are hidden from view by mattress M but it should be understood that they function in substantially the same manner as the arms 28', 24' and 20'. It should be noted, however, that the lower hidden arm which is equivalent to arm 20' is directly pivotally connected at its left-hand end to crib end 12 by a pivot assembly 33.

Arms 20' and 24' are hingedly connected by a combination hinge and lock assembly L" which is similar in design and function to the locking/pivotal connection L'. Likewise, the lower arms hidden by mattress M and are similar to upper arms 20' and 24' and are hingedly connected by a combination hinge/lock assembly similar to assembly L.

Mattress M is either provided with a rigid supporting board or is placed on a separate supporting board, preferably supported at its ends by support portions such as by clips preferably provided on inward facing sides of cross-pieces 13 and 15 and/or the vertical leg portions of the crib ends 12 and 14, as is conventional. Mattress M preferably has supporting ribs arranged along its long sides to provide structural support there along.

The sides S1 and S2 each have a plurality of elongated spaced parallel members 27, typically referred to as "slats", which are joined to the upper and lower arm assemblies in a manner similar to the spaced parallel members 12*c*, 14*c*

Figure 2:
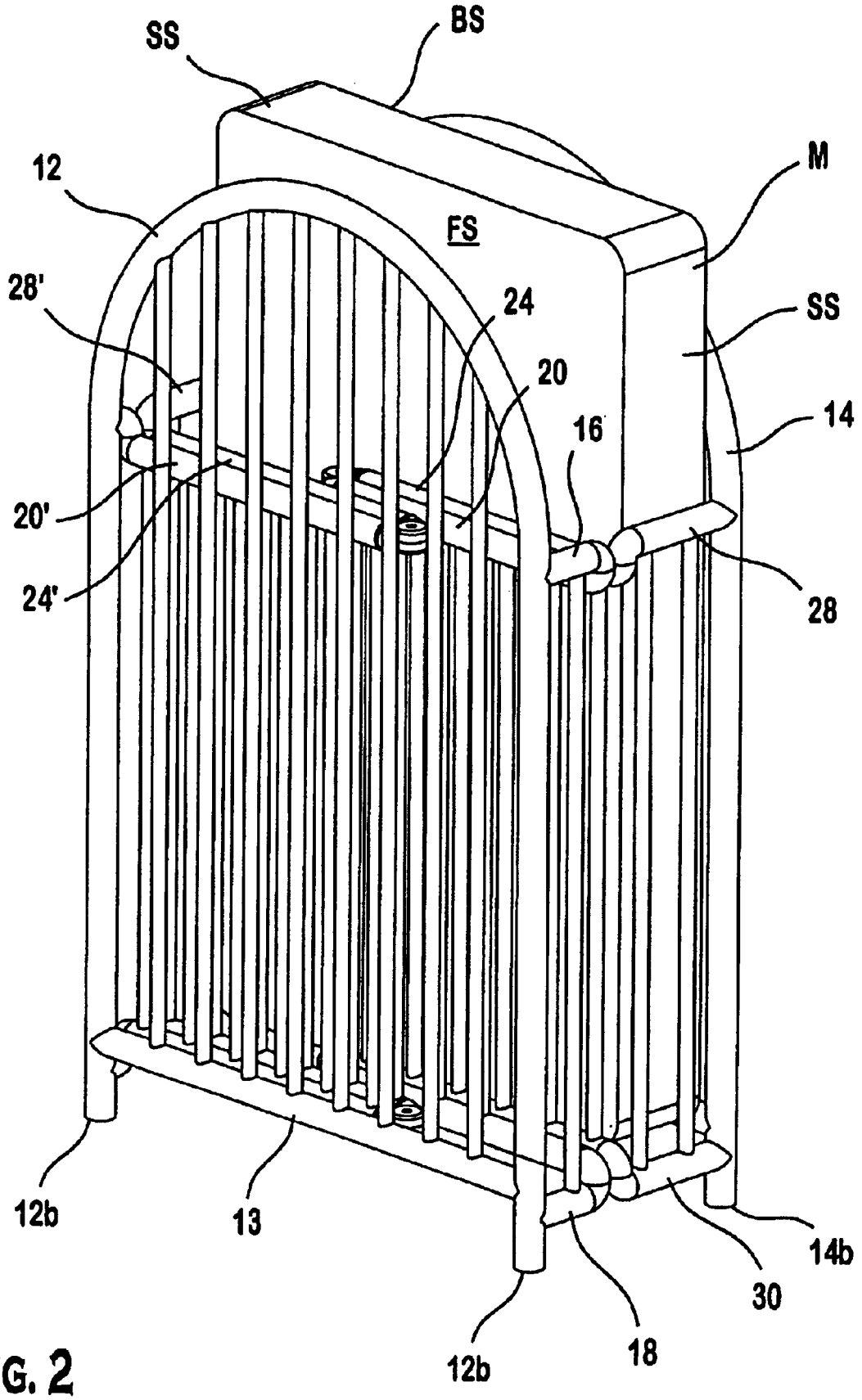
FIG. 2 is a perspective view showing the foldable crib of FIG. 1 in the folded position.

Making reference to the collapsed view of the crib 10 shown in FIG. 2, mattress M is moved from the assembled position shown in FIG. 1 to the upright position shown in FIG. 2. Arm 20', in the folded position, is immediately adjacent the inner side of crib end 12. Arm 24' folds directly against arm 20'. Arm 20 folds against a portion of arm 24'. This folded arrangement is obtained as a result of the short stationary arm 16 to which arm 20 is pivotally connected, assuring side by side arrangement of the arms 20', 24', 20 and 24. Also, by arranging arms 24 and 20 below arms 28 and 16, this allows the arms to pivot freely relative to one another and be positioned in close proximity when folded. This is also true of the arms on the lower end of side S1 and of the arms on the upper and lower ends of sides S2.

Arm 24 rests directly against arm 20. It should be noted that stationary arm 28' is longer than stationary arm 28 to provide adequate space for arms 20' and 24. Arm 16, which spaces the left-hand end of arm 20 at a greater distance from crib end 12 than the left-hand end of arm 20' (which is pivotally connected to pivot 32), performs a function similar to arms 28, 28' by providing adequate space for arms 20' and 24'. The length of arm 28 is chosen so that mattress M fits snuggly between crib end 14, arm 28, arm 24 and arm 28', which four (4) arms confine the side surfaces SS, front surface FS and back surface BS of the mattress M in the upright position shown in FIG. 2. Holding mattress M in the upright position with the long sides aligned vertically, further reduces the "footprint" of the crib.

Although FIG. 1 shows the upper sides and lower sides of the sidewalls as being provided with locking/pivotal connections L' and L, it should be understood that the lower end latch L may be omitted and replaced by a pivot assembly similar to pivot assemblies 19, 23.

Figure 4A:
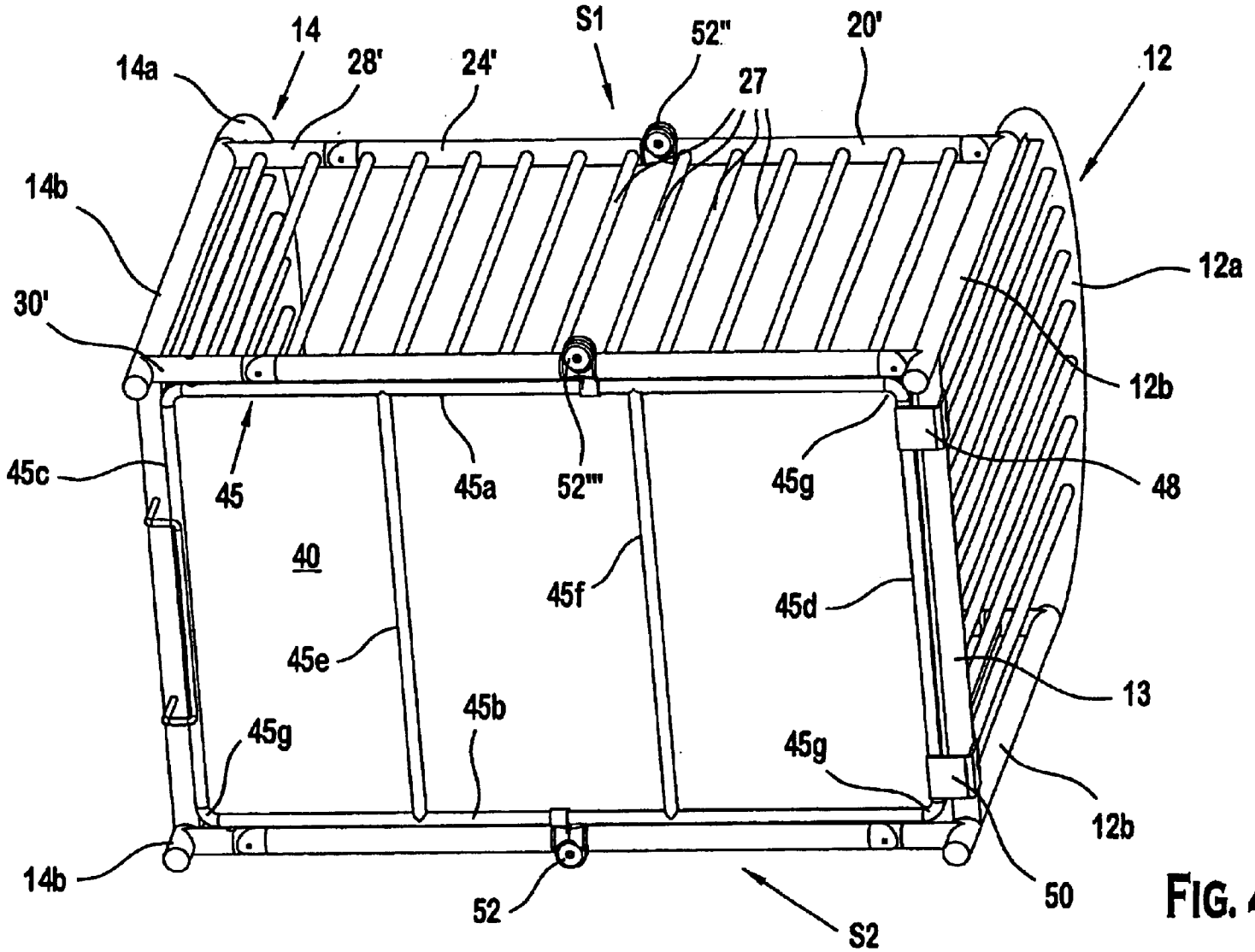
FIG. 4A is a perspective view of another alternative embodiment of the invention showing the bottom, one crib side and the headboard and footboard in the erected position.
Figure 4B:
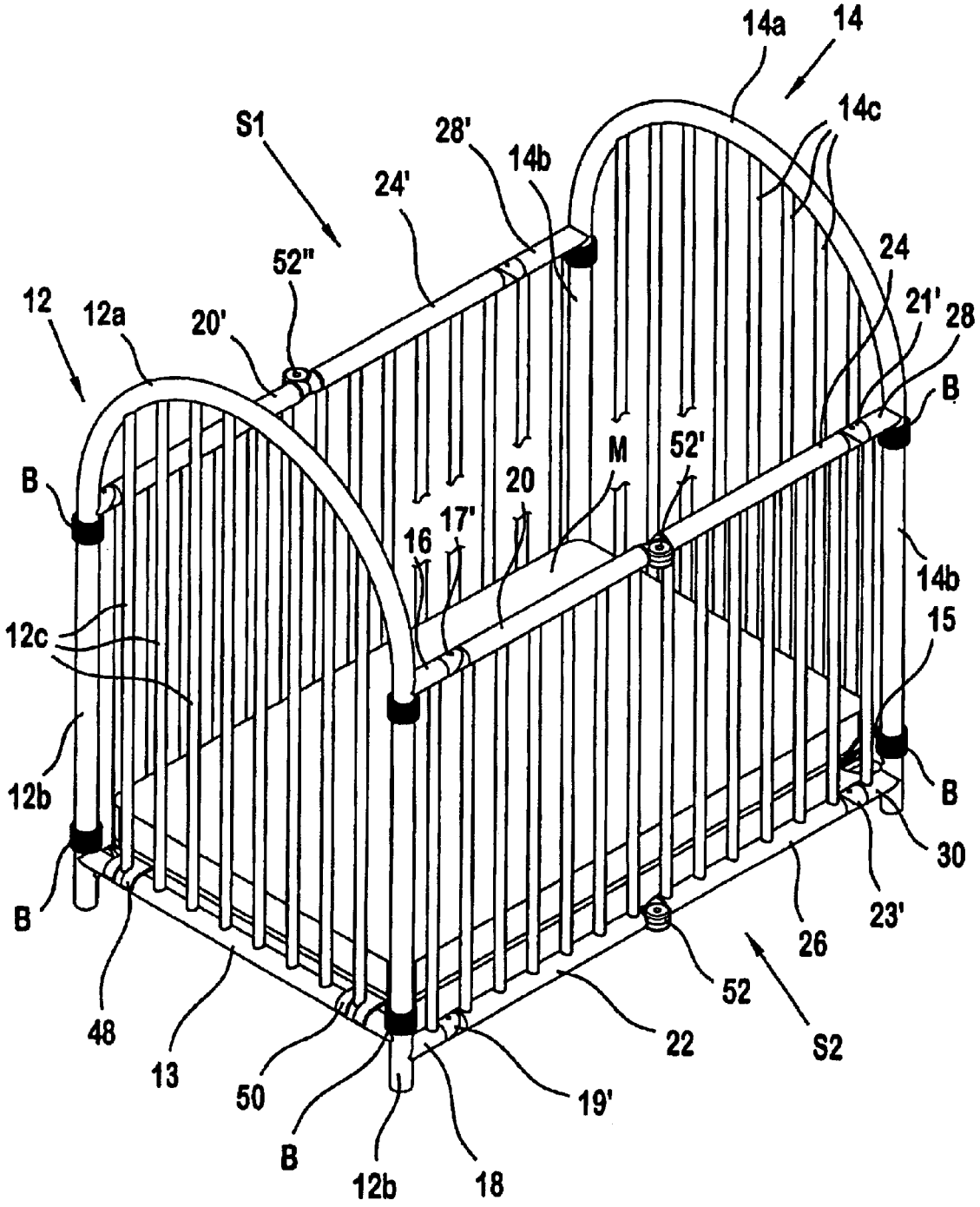
FIG. 4B is a perspective view of an embodiment similar to that shown in FIG. 4A showing the crib in the erect position and looking down on the crib to disclose the differences between FIGS. 4A and 4B.
Figure 5:
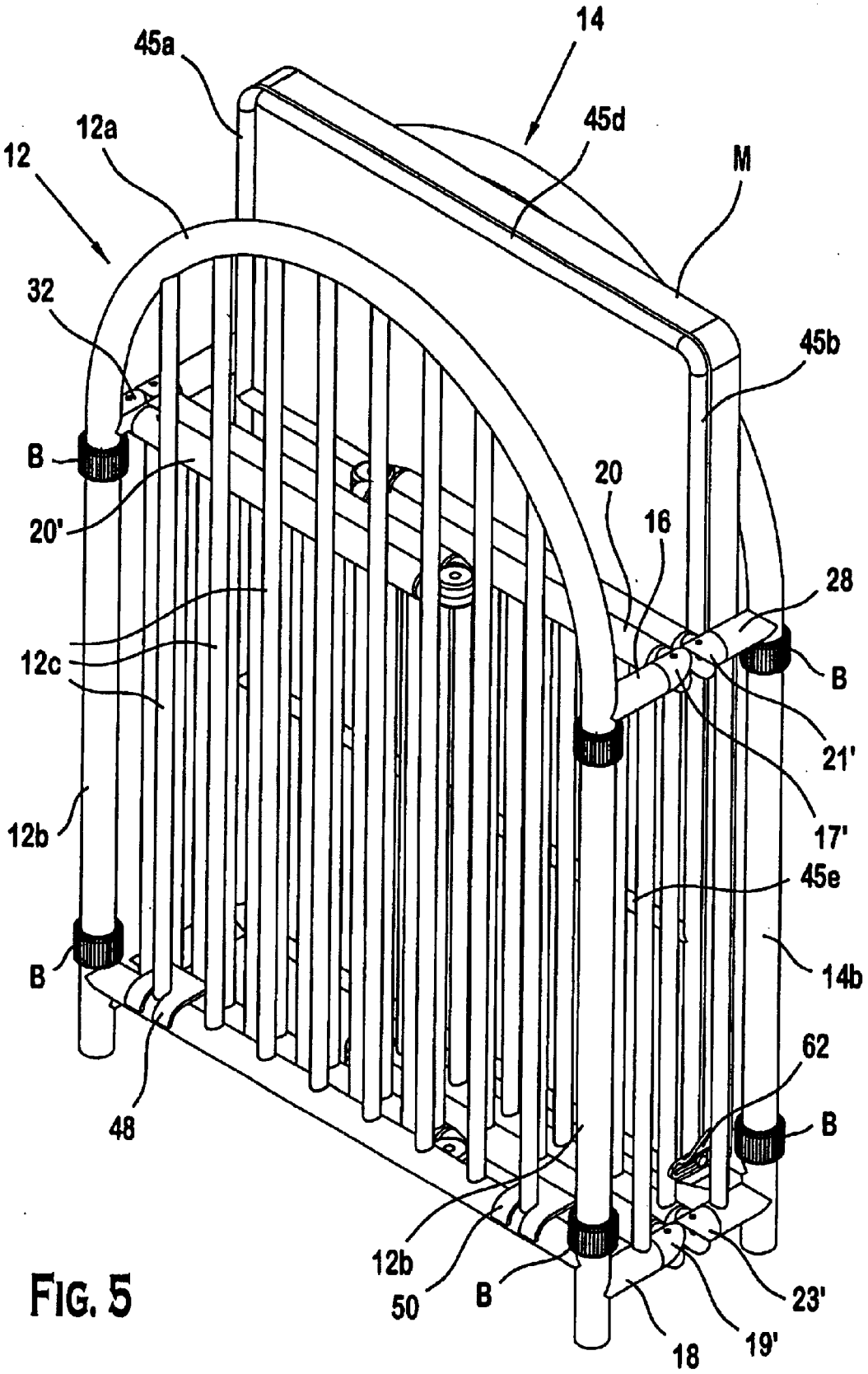
FIG. 5 is a perspective view of the FIG. 4B embodiment in the folded position.

FIGS. 4A, 4B and 5 show another embodiment 10' of the present invention wherein like elements as between the embodiment 10 of FIGS. 1 and 2 and the embodiment 10' of FIGS. 4A–5 are designated by like numerals. For purposes of simplicity, only the differences as between the embodiments 10 and 10' will now be described. Additional differences between FIG. 4A and FIGS. 4B–5 will be pointed out below.

One of the principal differences of the embodiment 10' is the utilization of aligned hinges employed to hingedly connect the upper and lower railings of the crib 10' sidewalls S1 and S2, which enables the arms, when the crib 10' is unfolded and erected as shown in FIGS. 4A and 4B, to have their longitudinal axes co-axial with one another. For example, making reference to FIG. 4B, hinge assemblies 17' and 21' of the upper railing of side S2, as well as hinge assemblies 19' and 23' of the lower railing of side S2, are in-line hinge assemblies. It should be noted that side S1 of crib 10' includes similar hinge assemblies which will not be discussed in detail for purposes of brevity. Noting FIG. 7C, which shows hinge assembly 23', in greater detail, the in-line hinge assembly 23' is comprised of hinge halves 23*a*' and 23*b*' having mounting portions of reduced diameter, which are telescopingly received within the hollow arms 26 and 30, respectively. These anchoring portions are secured to arms 26 and 30 by fastening members 23*c*' and 23*d*'. A vertically aligned pin 23*e*' pivotally connects the hinge halves 23*a*' and 23*b*' to one another. Member 23*a*' is maintained stationary while portion 23*b*' rotates about pivot pin 23*e*' when the portable crib 10' is moved between the folded and unfolded position. Members 23*a*' and 23*b*' have diagonally aligned engaging surfaces which meet along the diagonal line DL when the crib 10' is in the unfolded position and is erected for use. A spring (not shown) may be provided between one enlarged end of pin 23*e*' and one of the hinge halves to allow some displacement between the diagonally aligned engaging surfaces during rotation of member 23*a*' about pivot pin 23*e*'. All of the remaining in-line hinge assemblies 19', 17', and 21' are substantially similar in design and function to the in-line hinge assembly 23' and therefore a detailed description of the remaining in-line hinge assemblies will be omitted for purposes of brevity.

The in-line hinge assemblies 19', 23' and 17', 21' and offset hinge assemblies 52', 52 of the upper and lower railing of side S2, as well as the in-line hinge assemblies and offset hinge assemblies 52", 52'" of the upper and lower railing of side S1, enable the arms of the upper and lower railing of both sides S1 and S2 to be aligned so that their longitudinal axes are co-axial when the crib 10' is in the unfolded position shown in FIG. 4B.

Figure 7A:
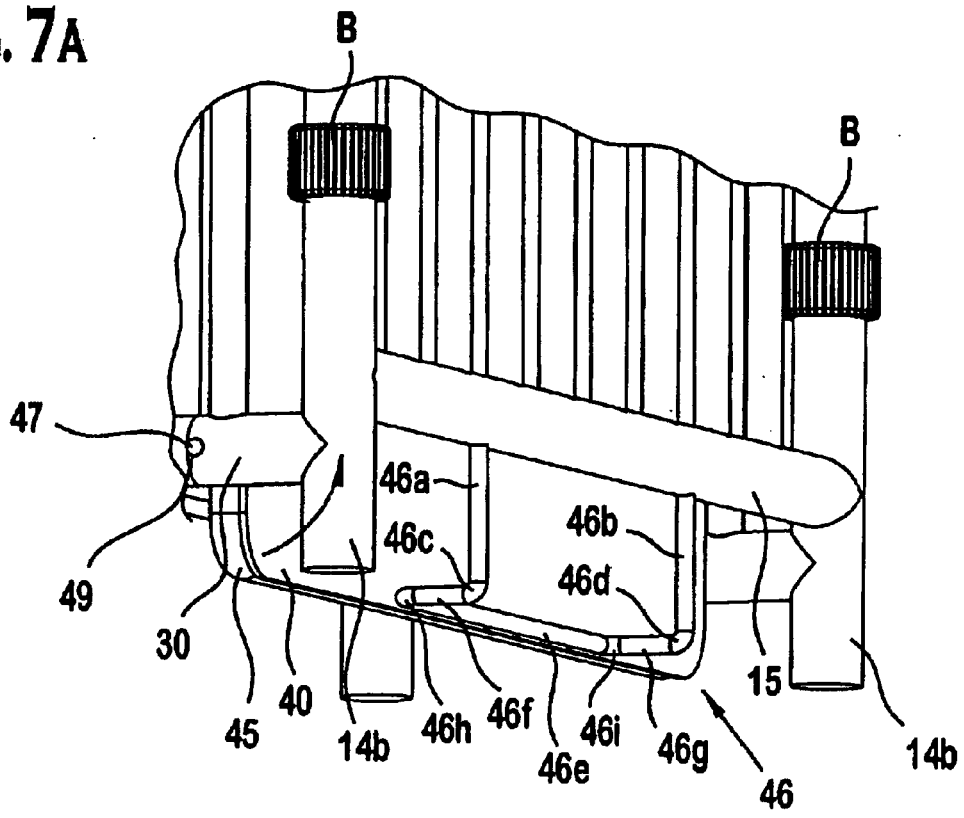
FIGS. 7A and 7B are perspective views respectively showing the manner in which the mattress support frame is mounted to the crib and the manner in which the mattress is supported when the crib is in the folded position.
Figure 7B:
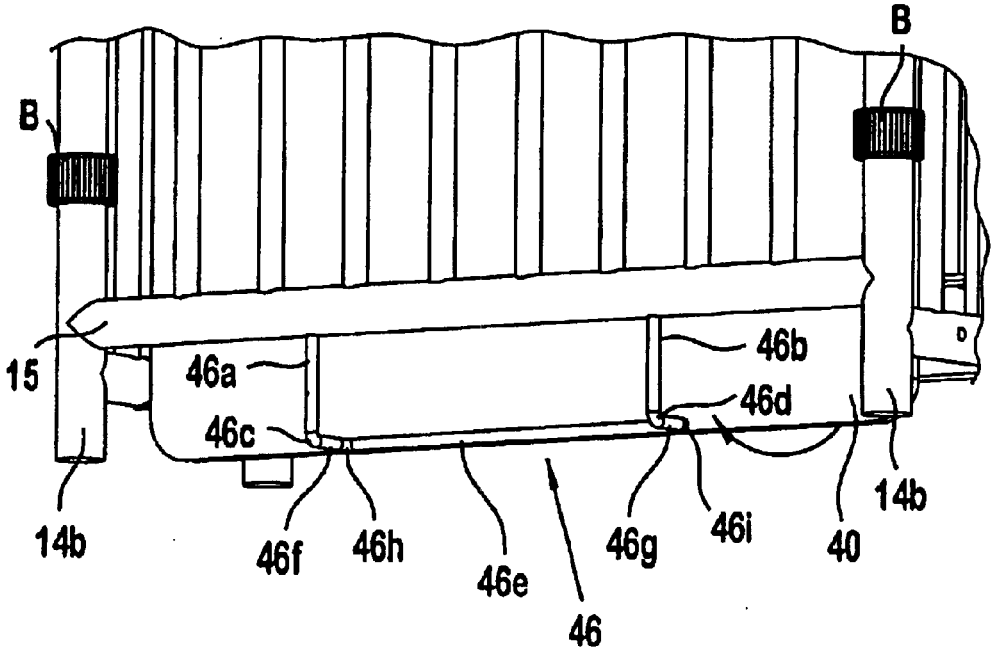
Figure 7C:
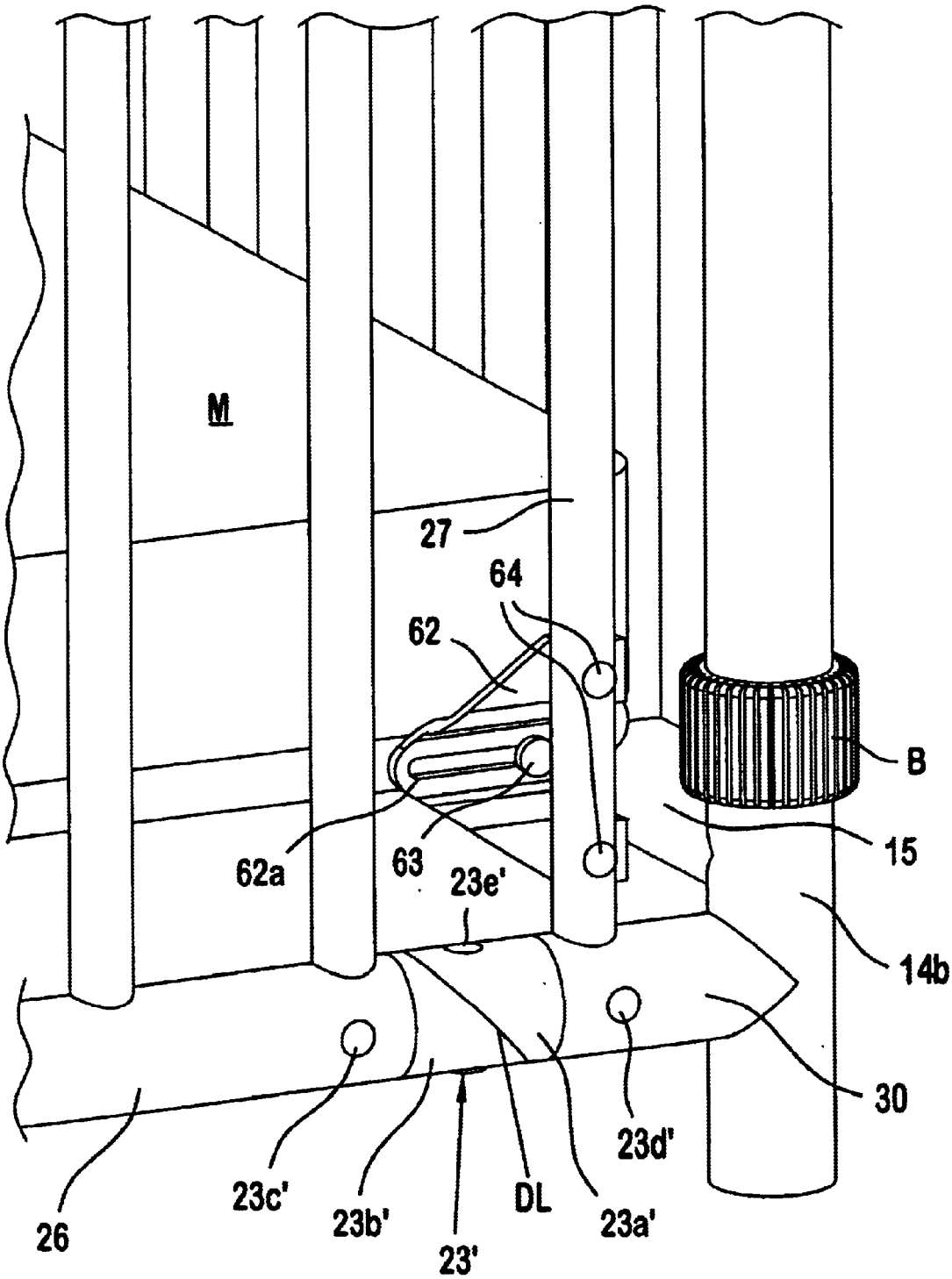
FIG. 7C is a detailed perspective view of one of the in-line hinges shown in FIGS. 4A and 5, for example.
Figure 7D:
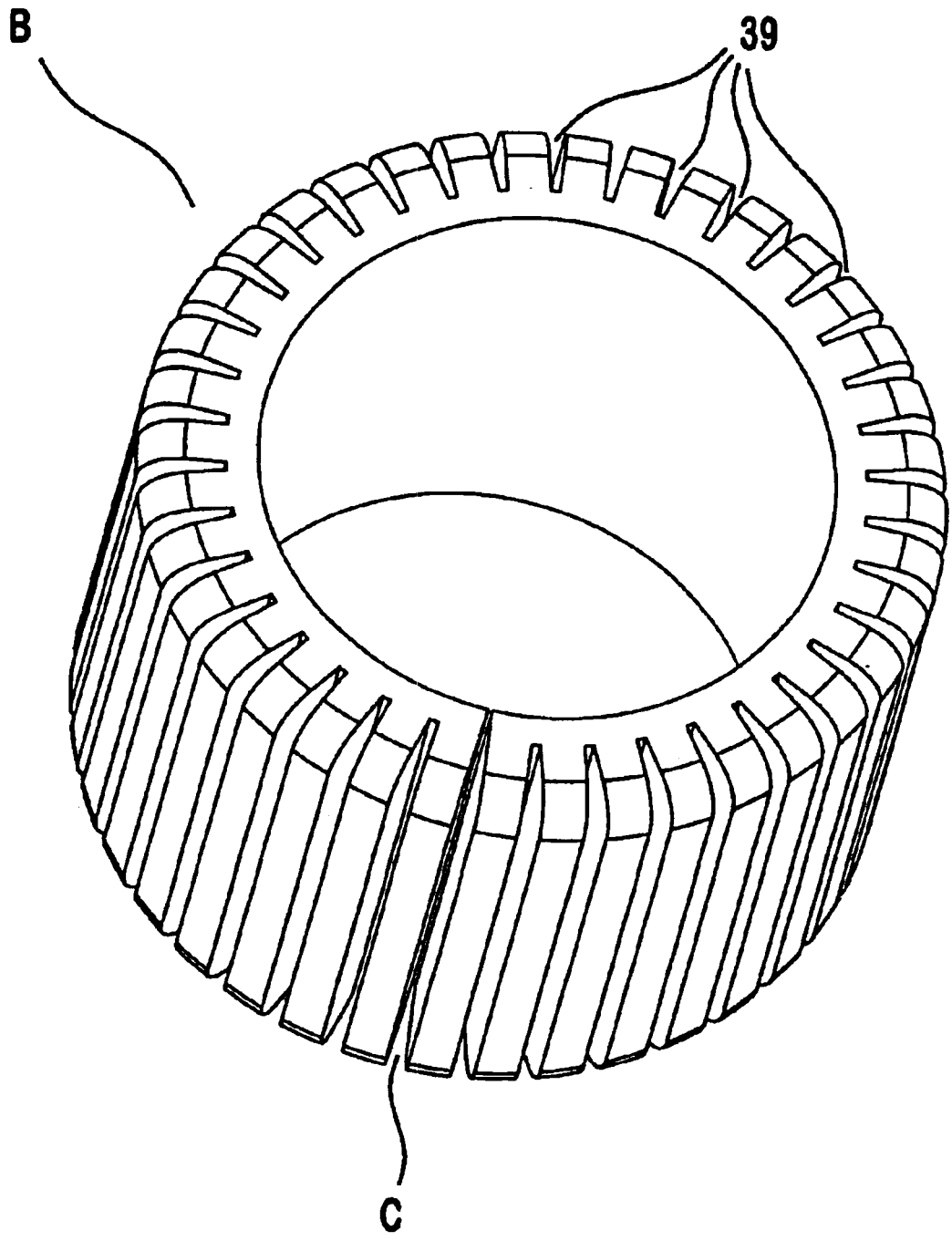
FIG. 7D is a perspective view of one of the bumpers provided in the embodiment of FIG. 5, for example.

Each of the pairs of legs 12*b* and 14*b* is provided with annular-shaped bumpers B, one of which is shown in greater detail in FIG. 7D. The bumpers B are preferably made of rubber or rubber-like material, however, it can be appreciated by one of skill in the art that other suitable materials may be used. Each of the bumpers B is provided with radial slots 39 extending inwardly from the outer periphery thereof and terminating a spaced distance from the inner, smooth surface of the bumper B. The bumper B is provided with a through-cut C to enable each bumper to be mounted to one of the associated legs 12*b*, 14*b*. Preferably each leg is provided with two (2) spaced apart bumpers B, as shown best in FIG. 5.

The embodiment 10', in addition to incorporating a mattress M, further includes a rigid support member 40 made of suitable board or board-like material. A rigid frame 45 is secured to the underside of support member 40 as shown best in FIG. 4A. The frame 45 has two (2) long sides 45*a* and 45*b* respectively running parallel to the crib sides S1 and S2, and two short sides 45*c* and 45*d* which extend parallel to the crib ends 12 and 14. Opposite ends of long sides 45*a* and 45*b* are joined to adjacent ends of short sides 45*c* and 45*d* to form integral curved corners such as corners 45*g*.

Frame 45 is further comprised of a pair of cross pieces 45*e* and 45*f* aligned parallel to the short sides 45*c* and 45*d*. All of the frame members 45*a*–45*f* are secured to the underside of support member 40. The frame members 45*a*–45*f* may be hollow, tubular metallic or plastic members or may be solid members formed of wood, plastic or the like.

A pair of pivot pins 47, such as the pivot pin 47 shown in FIG. 7A, are arranged along opposite sides (S1 and S2) of the frame 45 to pivotally mount the frame 45 and support member 40 to the crib 10'. More specifically, pivot pin 47 extends through an opening in lower arm 30 of side S2 and a similar pivot pin (not shown) extends through lower arm 30' of crib side S1 (see FIG. 4B) to pivotally mount frame 45 and hence the frame members 45*a*–45*f* and support member 40 to the crib assembly 10'.

The embodiment 10'is moved from the unfolded position shown in FIGS. 4A and 4B, to the folded position shown in FIG. 5, preferably by lifting the frame 45 at the end where short side 45*d* is located, causing the right-hand end of the frame 45, support member 40 and mattress M relative to FIG. 4A, to be lifted and pivot about the aforementioned pivot pins, such as pivot pin 47. These pivot pins 47 permit the frame 45 and support member 40 to be swung to the vertical position shown in FIG. 5. Although support member 40 is fixedly secured to the frame 45 in the embodiment of FIG. 4A, mattress M is not fixedly secured to the upper surface of support member 40 and is free to be lifted out for purposes of cleaning, mounting a sheet upon the mattress, etc. To prevent the mattress from slipping downwardly from the frame 45 when it has been moved to the vertical position, cross piece 15, provided at crib end 14, has secured thereto a wire-like mattress supporting bracket 46, shown in FIGS. 7A and 7B and having two vertically aligned, downwardly depending arms 46*a*, 46*b* with their upper ends being secured to cross piece 15 by any suitable fastening arrangement such as welding or the like. Arms 46*a* and 46*b* are bent inwardly forming bent portions 46*c*, 46*d* to thereby form a horizontally aligned C-shaped support frame comprised of elongated portion 46*e* integrally joined to the outer ends of horizontally aligned portions 46*f* and 46*g* along bends 46*h* and 46*i*. When the frame 45 and support member 40 are moved to the vertical position shown in FIG. 7A, in which the mattress M has been omitted for purposes of clarification, the C-shaped support comprised of the wire portions 46*e*, 46*f*, and 46*g*, engage the lower end of the mattress M and thereby support the mattress M in the vertical position.

When it is desired to move the crib from the folded position shown in FIG. 5 to the unfolded position, shown, for example, in FIG. 4A, the left-hand end of the mattress M, support member 40 and frame 45 are lowered, enabling the frame 45 and support member 40 to pivot about the pivot pins such as pin 47. As the frame 45 and support member 40 are moved to the horizontal position, the frame 45 is supported by a pair of brackets 48 and 50 joined to cross-piece 13 forming part of the crib end 12, as shown in FIG. 4B and extending inwardly so as to support opposite ends of the frame 45 short piece 45*d* at locations near the corners 45*g* of the frame 45, thus supporting the frame 45, support member 40 and mattress M in the unfolded and erected position. If desired, the pivot pins 47 may be omitted and replaced by brackets similar to brackets 48 and 50 and arranged along the cross-piece 15.

FIGS. 4B, 5 and 7C depict another alternative manner for pivotally mounting the frame 45 to the crib. A pair of triangular brackets 62, only one being shown in FIGS. 4B, 5 and 7C, are each secured to one of the two vertical slats 27 by fasteners 64, only one bracket being described for simplicity. Bracket 62 has an elongated slot 62*a*. A pivot pin 63 slides within slot 62*a* and is secured to frame side 45*a*. The frame 45, support member 40, and mattress M pivot about pins 64 when the end of frame 45 opposite pivot pins 64 is lifted. Slot 62*a* provides clearance for the frame 45, support member 40, and mattress M, enabling these members to move between the erected and folded positions and avoid interference with the crib end 14. In the embodiment of FIGS. 4B, 5 and 7C, the frame 45 is a spaced distance above the bottom side rails. The cross pieces 13 and 15 at the crib ends 12 and 14 may both be provided with brackets 48 and 50 to support both ends 45*c* and 45*d* of the frame 45. Note that the cross pieces 13 and 14 are a spaced distance above the bottom side rails, see members 15 and 30 in FIG. 7C, for example. The brackets 48, 50 are provided on both cross pieces 13, 15 serve to support substantially the full weight of the frame 45, support member 40, and mattress M thereby enabling use of a combination bracket 62 and pivot pin 63 of reduced strength and lighter weight.

Figure 6A:
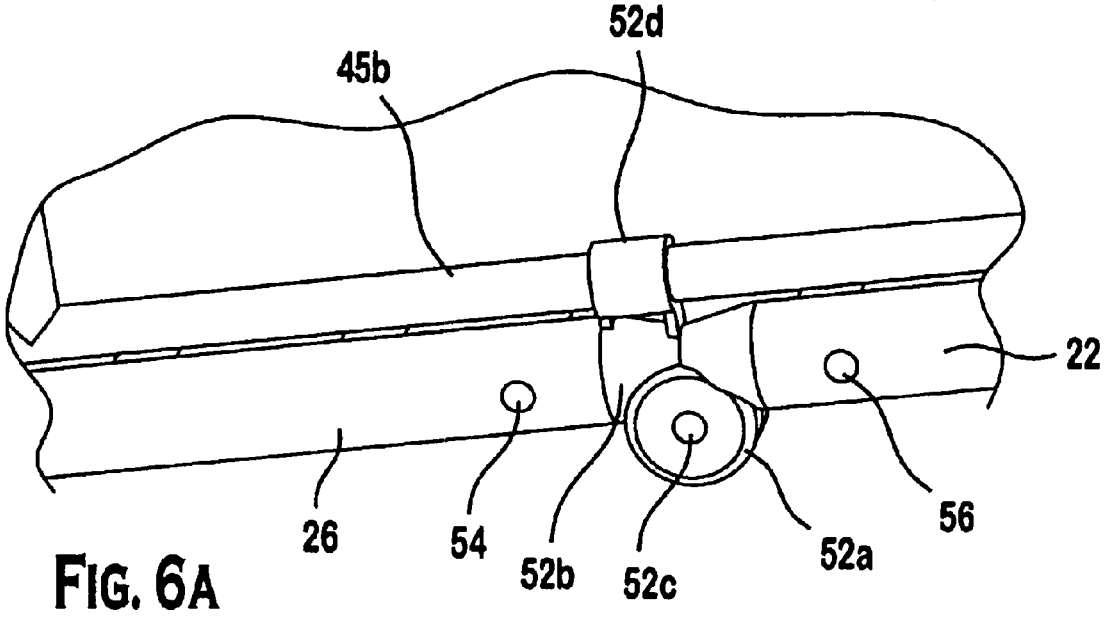
FIGS. 6A and 6B are perspective views respectively showing an offset hinge mounted to the associated arms of one of the crib sides and having the holding clip joined to the frame for supporting the mattress and one half of the offset hinge of FIG. 6A.
Figure 6B:
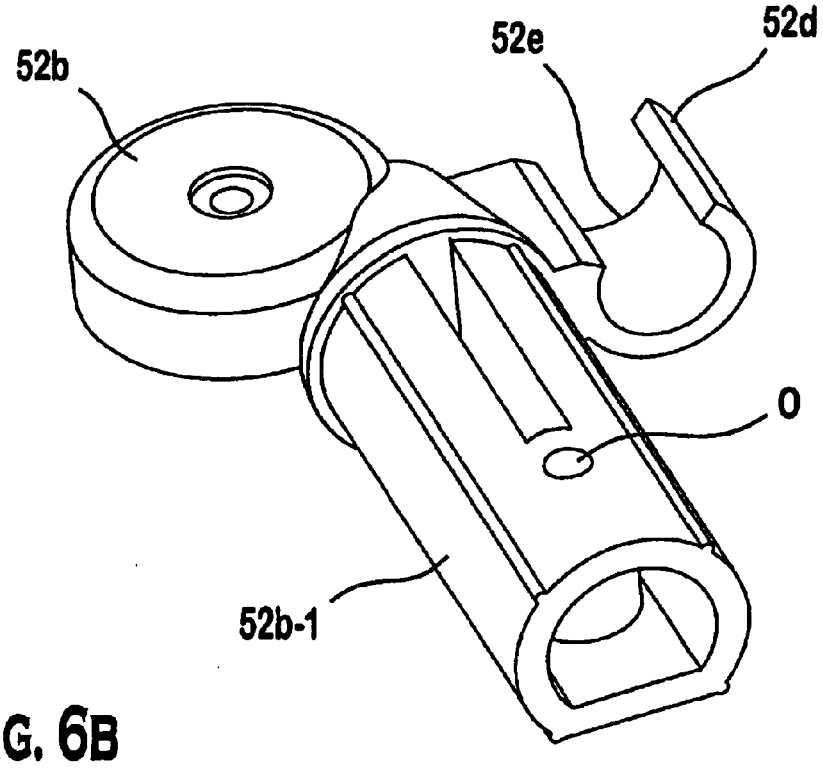

In order to provide additional structural strength to the lower railings, the offset hinge 52 shown in detail in FIG. 6A, is provided with an integral locking bracket 52*d*. The offset hinge assembly 52 shown in FIGS. 6A and 6B is similar to locking/pivotal connection L shown in FIGS. 3A and 3B and is comprised of cooperating hinge halves 52*a* and 52*b* each having integral, reduced diameter portions for insertion into adjacent lower rail members 26, 22, the reduced diameter portions (only one being shown in FIG. 6B) being secured to arms 26 and 22 by suitable fasteners through openings 54 and 56 on arms 26, 22. The hinge halves 52*a* and 52*b* are secured by a hinge pin 52*c* which enables the hinge halves to pivot about hinge pin 52*c* relative to one another. A locking bracket 52*d* is integrally joined to hinge 52*b* shown in greater detail in FIG. 6B. The locking bracket 52*d* has a curved configuration which conforms to the shape of the associated frame member so that when the crib 10' is moved to the unfolded and erect position and the frame 45, and support member 40 are lowered, the long sides such as, for example, the long side 45*b* of frame 45 snaps into mating engagement with the concave surface 52*e* of the locking bracket 52*d*. It should be understood that locking bracket 52*d* is provided at each of the lower railings on each of the crib sides S1 and S2, providing rigidity to the crib sides S1 and S2 when the crib 10' and mattress M are in the erected position. The locking brackets 52*d* are not relied upon to provide supporting strength to the mid-portion of the frame 45 and support member 40 but do provide a locking feature to prevent the sides S1 and S2 from moving either toward one another or away from another about the offset hinges 52, 52' thereby rigidifying the sides S1 and S2. It should be noted that the locking bracket 52*d* is shaped to conform to the frame member which it receives and if the frame member has a rectangular, square or other polygonal shape, the locking bracket 52*d* is designed to have a shape to conform thereto. The upper hinges 52', 52" may have locking members of the type shown in FIGS. 3A and 3B, see member 42 having a projection which snap fits into a button 44.

FIG. 6B shows the portion 52*b*-1 of hinge half 52*b* which is inserted into the hollow opening of lower rail member 26, for example. Openings on opposite sides of the reduced diameter portion 52*b*-1, such as opening O, receive the fastening member to secure the hinge half 52*b* to rail member 26. The hinge half 52*a* is secured to rail member 22 in similar fashion. The hinge 52 is also shown in FIG. 4A. It should be noted that the embodiment of FIGS. 4A and 6A differ from that shown in FIGS. 4B, 5, and 7C in that the frame 45 and the lower rails of the crib lie in a common plane.

While various methods, configurations, and features of the present invention have been described above and shown in the drawings for the various embodiments of the present invention, those of ordinary skill in the art will appreciate from this disclosure that any combination of the above features can be used without departing from the scope of the present invention. Accordingly, it is recognized by those skilled in the art that changes may be made to the above described methods and embodiments of the invention without departing from the broad inventive concept thereof. It is understood, therefore, that this invention is not limited to the particular methods and embodiments disclosed, but is intended to cover all modifications which are within the spirit and scope of the invention as defined by the appended claims and/or shown in the attached drawings.

What is claimed is:

1. A crib comprising:

first and second crib ends;

first and second crib sides;

the first and second crib sides each having upper and lower railings, the upper and lower railings each being collapsible at pivot assemblies there along, the pivot assemblies being spaced so as to divide upper and lower railings of the first crib side into three sections and to divide upper and lower railings of the second crib side into four sections; and the crib providing a space for enclosing and holding a mattress in a vertical upright manner when folded to a collapsed position such that long sides of the mattress are vertically aligned and short sides of the mattress are horizontally aligned, when the crib is placed on a horizontal surface.

2. The crib of claim 1 wherein one major face of the mattress engages one of the crib ends in the folded position.

3. The crib of claim 1 wherein two intermediate sections of the upper and lower railings of the first and second crib sides are comprised of arm members of equal length.

4. The crib of claim 3 wherein the equal length arm sections of the upper and lower railings of the first and second crib sides are respectively joined to one another with an intermediate pivot assembly.

5. The crib of claim 4 wherein the intermediate pivot assemblies of the upper and lower railings of the first side are positioned closer to one of the crib ends than the intermediate pivot assemblies of the upper and lower railings of the second side when the crib is in the unfolded position.

6. The crib of claim 3 wherein one of the crib sides has fixed arm members of the upper and lower railings, each fixed arm member having one end thereof secured to one of the first and second crib ends and an opposite end pivotally connected to one of the two equal length arms, the fixed arm members being of a length at least equal to a thickness of the mattress.

7. The crib of claim 1 wherein a length of the three sections of the upper and lower railings of the first crib side is equal to a length of the four sections of the upper and lower railings of the second crib side when the crib is unfolded.

8. The crib of claim 1 wherein a plurality of spaced parallel slats have their upper and lower ends respectively joined to the upper and lower railings of the first and second crib sides.

9. The crib of claim 1 wherein two of the three sections of the first crib side are of equal length and a remaining one of the three sections is shorter in length than said two of said three sections.

10. The crib of claim 9 wherein said two sections of equal length are pivotally connected to one another.

11. The crib of claim 1 wherein two of the four sections of the second crib side are of equal length and the remaining two of the four sections are each shorter in length than said two of said four sections of equal length.

12. The crib of claim 11 wherein said two sections of equal length are pivotally connected to one another.

13. The crib of claim 1 wherein one of the first and second crib ends, one of the three sections of the first crib side and two of the four sections of the second crib side define a substantially enclosed space for storing the mattress when the crib is in a folded state whereby the mattress is held in the substantially enclosed space with its long sides being vertically aligned.

14. The crib of claim 1 further comprising a first mattress support pivotally connected to the crib sides to enable the mattress support to be moved between a horizontal position when the crib is unfolded and erected and a vertical position when the crib is folded.

15. The crib of claim 14 further comprising a second mattress support mounted at one end of the crib for supporting the mattress when the mattress and first mattress support are in the vertical position.

16. The crib of claim 14 further comprising a pair of brackets for supporting an end of the first mattress support opposite the end of the first mattress support which is pivotally mounted to the crib.

17. The crib of claim 1 further comprising a pair of brackets mounted to each end of the crib to support the mattress support when in a horizontal position.

18. The crib of claim 1 comprising a mattress support provided with a pair of elongated frame members each arranged to be adjacent to a lower rail of the first and second sides; with the pivot assemblies of the lower railings of the first and second crib sides each including an offset hinge having an integral frame-receiving bracket for receiving and retaining an associated adjacent elongated frame member when the first mattress support is in the horizontal position to maintain the crib sides in the unfolded position.

19. The crib of claim 1 further comprising a mattress support for supporting said mattress; and a pair of brackets arranged at opposite ends of the crib to support the mattress support when the crib is in an unfolded position.

20. The crib of claim 1, wherein each of the upper and lower railings of the first and second crib sides include three pivot assemblies.

21. The crib of claim 20, wherein the two outer pivot assemblies of each of the upper and lower railings of the first and second crib sides comprise in-line hinge assemblies such that their longitudinal axes are coaxial when the crib is in the unfolded position.

22. The crib of claim 20, wherein the two outer pivot assemblies of each of the upper and lower railings of the first and second crib sides comprise overlapping portions joined by a pivot pin such that their longitudinal axes are displaced from one another when the crib is in the unfolded position.

23. The crib of claim 20, wherein the inner pivot assembly of each of the upper and lower railings of the first and second crib sides consists of two cooperating brackets pivotally coupled together.

24. The crib of claim 23, wherein a snap securing assembly works in cooperation with the cooperating brackets to secure the upper and lower railings of the first and second crib side when the crib is in the unfolded position.

25. The crib of claim 20, wherein the inner pivot assembly of each of the upper and lower railings of the first and second crib sides consists of an offset hinge assembly, the offset hinge assembly having two cooperating hinge halves secured together by a hinge pin.

26. The crib of claim 25, wherein the offset hinge assembly of each of the lower railings of the first and second sides further comprises of an integral frame-receiving bracket for receiving and retaining an associated adjacent mattress support frame member when the crib is in the unfolded position.

27. The crib of claim 1, wherein the first and second crib ends each include a pair of leg members to support the crib, each of the leg members having a removable annular-shaped bumper.

28. The crib of claim 1, wherein the first and second crib ends each include a pair of leg members to support the crib, the bottom of each of the leg members having a caster secured thereto.

29. The crib of claim 1, wherein the upper and lower railings of the first and second sides are formed of a hollow tubular plastic or metallic material.

30. A foldable frame for a sleeper comprising:

first and second ends;

a first side extending between the ends with upper and lower rails that have pivot points located such that the first side rails each comprise three sections of which at least two fold upon themselves; and, a second side extending between the ends with upper and lower rails that have pivot points located such that the second rails each comprise four sections of which at least two fold upon themselves.

31. A foldable frame for a sleeper comprising:

first and second ends;

a first side extending between the ends with upper and lower rails that have pivot points located such that the first side rails each have three sections of which at least two fold upon themselves and lie adjacent to a selected one of the ends when folded; and, a second side extending between the ends with upper and lower rails that have pivot points located such that the second side rails each have four sections of which at least two fold upon themselves and lie adjacent to the folded sections of the first side when folded.

32. A foldable frame for a sleeper comprising:

first and second ends;

a first side extending between the ends with upper and lower rails that have pivot points located such that the first side rails each have three sections of which at least two fold upon themselves and lie adjacent to a selected one of the ends when folded; and, a second side extending between the ends with upper and lower rails that have pivot points located such that the second side rails each have four sections of which at least two fold upon themselves and the pivot points nearest to the selected one of the ends are located away from the selected one of the ends to define a space between the pivots points and the selected one of the ends that receives the folded sections of the first side.

33. A foldable frame for a sleeper comprising:

first and second ends;

a first side extending between the ends with upper and lower rails that have pivot points located such that the first side rails each have three sections of which at least two fold upon themselves and lie adjacent to a selected one of the ends when folded; and, a second side extending between the ends with upper and lower rails that have pivot points located such that the second side rails each have four sections of which at least two fold upon themselves and the pivot points nearest to the selected one of the ends are located away from the selected one of the ends to define a space between the pivot points and the selected one of the ends that receives the folded sections of the first side and the pivot points nearest the non-selected end are located away from the non-selected end to define a second space between the folded sections and the non-selected end.

* * * * *

UNITED STATES PATENT AND TRADEMARK OFFICE

CERTIFICATE OF CORRECTION

PATENT NO. : 6,907,627 B2
DATED : June 21, 2005
INVENTOR(S) : Waldman et al.

It is certified that error appears in the above-identified patent and that said Letters Patent is hereby corrected as shown below:

Column 8,
Line 64, after "support", delete "the" and insert -- a --.

Signed and Sealed this

Twenty-first Day of March, 2006

JON W. DUDAS
*Director of the United States Patent and Trademark Office*